United States Patent [19]

Sausner

[11] Patent Number: 4,759,331

[45] Date of Patent: Jul. 26, 1988

[54] ELECTROMAGNETICALLY ACTUATABLE FUEL-INJECTION VALVE

[75] Inventor: Andreas Sausner, Frankfurt am Main, Fed. Rep. of Germany

[73] Assignee: VDO Adolf Schindling AG, Frankfurt am Main, Fed. Rep. of Germany

[21] Appl. No.: 924,055

[22] Filed: Oct. 28, 1986

[30] Foreign Application Priority Data

Nov. 4, 1985 [DE] Fed. Rep. of Germany ..... 3539057

[51] Int. Cl.[4] ..... F02B 3/00

[52] U.S. Cl. ..... 125/472; 251/84; 251/88; 251/129.19; 239/585

[58] Field of Search ..... 123/472; 251/84, 85, 251/86, 87, 88, 129.19; 239/585

[56] References Cited

U.S. PATENT DOCUMENTS

| | | | |
|---|---|---|---|
| 293,355 | 2/1884 | Rappold | 251/88 |
| 391,445 | 10/1988 | Williams | 251/88 |
| 664,368 | 12/1900 | Grosse | 251/88 |
| 1,626,532 | 4/1927 | Heitemann | 251/88 |
| 1,942,417 | 1/1934 | Ferlin | 251/84 |
| 2,283,076 | 5/1942 | Mattimore | 251/84 |
| 2,752,937 | 7/1956 | Hieger | 251/84 |
| 3,310,277 | 3/1967 | Nielsen | 251/84 |
| 3,558,098 | 1/1971 | Puster | 251/88 |
| 3,936,030 | 2/1976 | Putschky | 251/129.19 |
| 4,218,021 | 8/1980 | Palma | 251/84 |

FOREIGN PATENT DOCUMENTS

| | | | |
|---|---|---|---|
| 1957112 | 9/1970 | Fed. Rep. of Germany | 251/84 |
| 2547598 | 4/1976 | Fed. Rep. of Germany | 251/129.19 |
| 885678 | 11/1981 | U.S.S.R. | 251/129.19 |

*Primary Examiner*—Ronald B. Cox
*Attorney, Agent, or Firm*—Martin A. Farber

[57] ABSTRACT

In an electromagnetically actuatable fuel-injection valve for injection systems of internal-combustion engines, the valve has an electromagnet, an armature, and a closure element which is operatively connected to a spring and the armature. The closure element is connected to a valve needle by a connection permitting displacement perpendicularly to the axis of the valve needle. The closure element, which has the shape of a spherical segment, is preferably displaceable while overcoming static friction so that automatic adjustment takes place only upon being placed initially in operation, and upon subsequent changes in mating surfaces of closure element and valve seat.

13 Claims, 2 Drawing Sheets

ELECTROMAGNETICALLY ACTUATABLE FUEL-INJECTION VALVE

FIELD AND BACKGROUND OF THE INVENTION

The invention relates to an electromagnetically actuatable fuel-injection valve for injection systems of internal-combustion engines, which valve has an electromagnet, an armature, and a closure element which is operatively connected to a spring and the armature.

In known fuel-injection valves the closure element is constructed as a valve needle which is guided axially in a suitably developed sleeve, and at the end thereof facing and injection opening, is conically shaped to rest tightly on a valve seat when the fuel-injection valve is closed. For this purpose, the needle is pressed in the direction of the valve seat by a suitable spring. When current flows through the electromagnet the valve needle is lifted off the seat and thus opens the injection opening.

However, a very precise centering of the valve needle is necessary in order to assure a sufficient seal in its closed state. This precise centering can be obtained only by a very high precise machining of the close-tolerance parts of the valve.

SUMMARY OF THE INVENTION

The object of the present invention is to provide an electromagnetically actuatable fuel-injection valve in which such high demands need not be made on the precision of the machining of the individual parts, thus resulting in economical manufacture.

This object of the invention is achieved in the manner that a closure element is so connected to a valve needle that the closure element is displaceable perpendicularly to the axis of the valve needle. By the development of a fuel-injection valve in accordance with the invention, self-centering of the closure element is made possible so that deviations of the valve needle from its axial position are substantially less critical than in the case of the known fuel-injection valves.

In accordance with a further feature, the closure element is displaceable while overcoming static friction, which provides assurance that the closure element will not move into a different position upon every opening of the valve and have to be centered again upon its closing. Centering is effected then only when the valve is first placed in operation or upon long-term changes, for example as a result of wear.

In accordance with another feature of the invention, the closure element is developed with the shape of a spherical segment and has a hollow space into which a ram-shaped end of the valve needle extends. In one particular embodiment thereof, the end surface of the valve needle is flat and rests on a flat surface which delimits the hollow space. For better adaptation of the spherical surface of the closure member to the valve seat, both surfaces preferably intersect approximately in the plane of the valve seat when the fuel-injection valve is closed. The development of the closure element in the shape of a spherical segment not only permits compensation for mispositioning of the valve needle in radial direction, but also permits compensation for mispositioning in a direction of the axis of the valve needle which deviates from the axis of the valve seat.

A further aspect of the invention provides for an opening of the hollow space having a smaller diameter than the hollow space itself, and that the ram-shaped end of the valve needle has a diameter which is smaller than the diameter of the hollow space but larger than the diameter of the opening. A spring element is then preferably interposed between the ram-shaped end of the valve needle and that part of the closure element that forms the opening of the hollow space. By this further development, the invention can be constructed in a simple manner with the use of only a few parts.

Finally, in another aspect of the invention the closure element consists of two parts, one of which is approximately hemispherical and is arranged opposite the valve seat while the other part, which is arranged coaxially to the first part, contains the opening to the hollow space. The place of connection of the two parts preferably has a centering edge. This feature contributes to the simple and economical manufacture of the fuel-injection valve of the invention.

BRIEF DESCRIPTION OF THE DRAWINGS

The invention permits numerous embodiments. One of them is shown diagrammatically in the drawing in several figures and will be described below. In the drawing.

Identical parts are provided with the same reference numbers in the figures.

DETAILED DESCRIPTION OF THE PREFERRED EMBODIMENT

Figure 1:
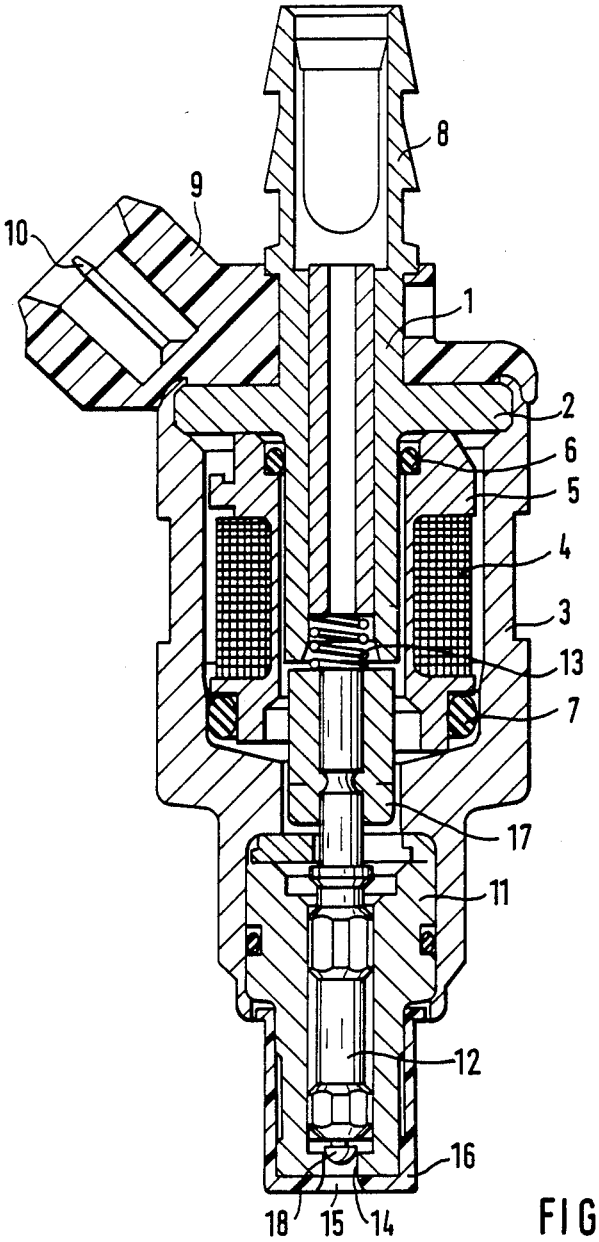
FIG. 1 is a section through a fuel-injection valve.

In the fuel-injection valve shown in FIG. 1, a tube 1, a flange-like part 2 of the tube 1 and a housing 3 form a magnetically conductive core for a magnet coil 4 which is arranged on a winding form 5. Seals 6, 7 are provided between the winding form 5, on the one hand, and the tube 1 and housing 3 on the other hand.

An extension 8 of the tube 1 serves as connection for a fuel line. A plastic member 9 together with a contact 10 form the electrical connection for the magnet coil 4.

Within a guide part 11 there is mounted a valve needle 12 which is pressed by the lower part of a coil spring 13 against a valve seat 14. The valve seat 14 is part of an ejection opening 15 which is provided in the guide part 11 and continues into an opening in the cap 16.

On that end of the valve needle 12 which is remote from the ejection opening 15 there is provided an armature 17 which, when current flows through the magnet coil 4, is pulled against the force of the spring in the direction towards the tube 1 and thus opens the valve.

In known fuel-injection valves, the end of the valve needle which serves as closure member is conically shaped, so that it rests in the form of a circular ring on the surface of a valve seat. In order to obtain a sufficient sealing action here, extremely small manufacturing tolerances must be satisfied, both on the part of the valve needle 12 itself and on the part of the guide part 11. In accordance with the invention, a closure element 18 is now so connected with the valve needle 12 as to be displaceable perpendicularly to an axis of the valve needle 12. For this is purpose a hemispherical closure element 18 is provided in the fuel-injection valve of FIG. 1 the element 18 being fastened to the valve needle 12 in a manner described in connection with FIG. 2.

Figure 2:
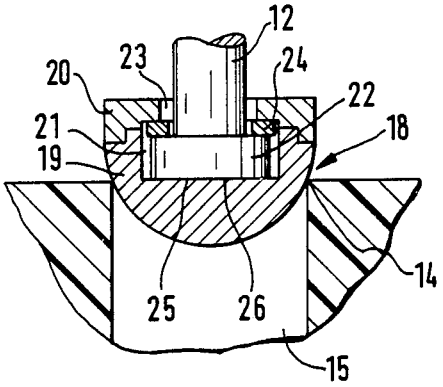
FIG. 2 shows a closure element, a valve seat and a part of a valve needle on a larger scale, and FIG. 3 comprises FIGS. *3a* and *3b*, shows the same parts as FIG. 2, but with a mispositioning of the valve needle shown in exaggerated fashion for ease in comprehension.

FIG. 2 is a section through the closure element 18 on a scale larger than in FIG. 1. The closure element 18 consists of a substantially hemispherical part 19 and a part 20. The closure element 18 has a hollow space 21 into which a ram-shaped end 22 of the valve needle 12 extends. Both the diameter of the hollow space 21 and an diameter of the opening 23 in the part 20 are selected sufficiently large that the closure element 18 can shift in position with respect to the axis of the valve needle 12 by an amount necessary to compensate for dimensional tolerances in the valve needle 12 and of its mounting.

An annular spring 24 ensures that an end surface 25 of the valve needle is pressed against a surface 26 of the hemispherical part 19. The application pressure here is so great that the closure element 18 does not shift position with respect to the valve needle 12 when the valve is open. The adherence force produced by the pressing is therefore greater than forces which occur when the valve is open, for instance as a result of vibration, which might cause displacement. The closure element 18 therefore need not be readjusted upon each closing process but only when this is necessary. An initial adjustment therefore takes place upon first placing the valve in operation, for instance upon a testing after a mounting of the fuel-injection valve. Further adjustments then take place only should changes occur during the course of the life of the fuel-injection valve.

Figure 3A:
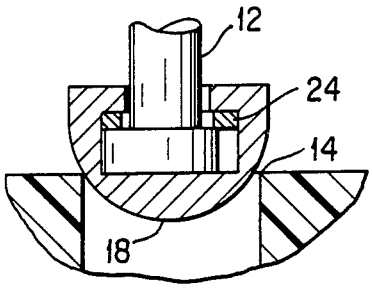

FIG. 3 shows the closure element 18, the valve seat 14 and the valve needle 12 for different mispositionings, strongly exaggerated in each case, of the axis of the valve needle 12. In FIG. 3*a* the axis of the valve needle 12 has been shifted parallel to its proper position. The arrangement is shown during a phase of movement of the closing process in which the closure element 18, which does not lie on the axis, contacts the valve seat 14 on one side. As is readily apparent, the closure element 18 then slides, with simultaneous displacement with respect to the axis of the valve needle 12, into the valve seat 14 and is thus adjusted.

Figure 3B:
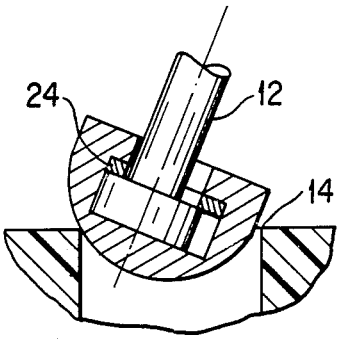

In FIG. 3*b* the axis of the valve needle 12 is tilted, which might be compensated for already by the hemispherical closure element 18. However, since the tilting has not taken place around the center point of the sphere, the axis of the valve needle 12 at the same time shifts out of the axis of the valve in the region of the closure element. This is compensated for by the displacement of the closure element 18 on the valve needle 12.

I claim:

1. An electromagnetically actuatable fuel-injection valve for injection systems of internal-combustion engines, the valve comprising an electromagnet, an armature, a spring, a valve seat, and a valve needle which is operatively connected at a first end thereof to the spring and the armature; and wherein the valve further comprises a closure element including connection means, said closure element being connected to the valve needle at a second end thereof opposite said first end by said connection means, said connection means enabling the closure element to be displaceable perpendicularly to an axis of the valve needle;

said closure element is displaceable in a direction transverse to the axis of said needle, said second end of said valve needle being a ram-shaped end; and said closure element has the shape of a spherical segment, said connection means having a hollow space for receiving the ram-shaped end of said valve needle, a surface of the ram-shaped end of said valve needle is flat, and rests on an interior flat surface of the closure element, which interior surface delimits the hollow space; and wherein both of said flat surfaces are located approximately in a plane of the valve seat when the fuel-injection valve is closed.

2. An electromagnetically actuatable fuel-injection valve for injection system of internal-combustion engines, the valve comprising an electromagnet, an armature, a spring, a valve seat, and a valve needle which is operatively connected at a first end thereof to the spring and the armature; and wherein the valve further comprises a closure element including connection means, said closure element being connected to the valve needle at a second end thereof opposite said first end by said connection means, said connection means enabling the closure element to be disiplaceable perpendicularly to an axis of the valve needle;

said second end of said valve needle being a ram-shaped end; and said closure element has the shape of a spherical segment, said connection means having a hollow space for receiving the ram-shaped end of said valve needle;

a surface of the ram-shaped end of said valve needle is flat, and rests on an interior flat surface of the closure element, which interior surface delimits the hollow space;

an opening of the hollow space has a smaller diameter than the hollow space itself; and the ram-shaped end of said valve needle has a diameter which is smaller than the diameter of the hollow space but larger than the diameter of the opening; and wherein said connection means comprises a spring element interposed between the ram-shaped end of said valve needle and a part of said closure element which forms said opening of said hollow space; and wherein both of said flat surfaces are located approximately in a plane of the valve seat when the fuel-injection valve is closed.

3. An electromagnetically actuatable fuel-injection valve for injection systems of internal-combustion engines, the valve comprising a valve needle;

an electromagnet and a spring operatively connected to a first end of said needle for displacing said needle along a longitudinal axis of the needle;

a valve seat;

a closure element carried by a second end of said needle, opposite said first end of said needle, said closure element being engageable with said valve seat upon displacement of said needles; and connection means for securing said closure element to said second end of said needle, said connection means including a sliding flat surface disposed as an interface between said needle and said closure element allowing for a transverse displacement of said closure element relative to said needle in a direction transverse to said needle axis; and wherein the flat surface of said connection means is located approximately in a plane of the valve seat when the fuel injection valve is closed.

4. The electromagnetically actuatable fuel-injection valve according to claim 1, wherein an opening of the hollow space has a smaller diameter than the hollow space itself; and the ram-shaped end of said valve needle has a diameter which is smaller than the diameter of the hollow space but larger than the diameter of the opening.

5. The electromagnetically actuatable fuel-injection valve according to claim 4, wherein said closure element comprises a first part and a second part, the first closure part being approximately hemispherical and being positioned opposite said valve seat; and wherein said second closure part is arranged coaxially to said first closure part and includes the opening to said hollow space.

6. the electromagnetically actuatable fuel-injection valve according to claim 5, wherein a place of connection of said two closure parts has a centering edge.

7. The electromagnetically actuatable fuel-injection valve according to claim 1, further comprising means for guiding a displacement of said closure element in said transverse direction.

8. The valve according to claim 3 wherein said sliding surface is perpendicular to said needle axis.

9. The valve according to claim 8 wherein said closure element includes a hollow space opening toward said needle, said sliding surface being located in said hollow space.

10. The value according to claim 9 wherein said connection means includes a ram fixed to said second end of said needle, said ram riding on said sliding surface.

11. The valve according to claim 10 wherein said hollow space has a diameter larger than a diameter of said needle, and said ram has a diameter larger than the needle diameter and smaller than the diameter of the hollow space to permit transverse motion of said ram within said hollow space.

12. The valve according to claim 11 wherein said ram sits within said hollow space, said connection means including retainer means disposed about an opening of said hollow space and secured to said closure element for retaining said ram in said hollow space.

13. The valve according to claim 12 wherein said retainer means includes an annular spring encircling said needle and engaging said ram on a side thereof opposite said sliding surface, said annular spring urging said ram toward said sliding surface to develop a predetermined frictional force between said ram and said closure element.

* * * * *